United States Patent [19]

Clouser et al.

[11] 4,232,233

[45] Nov. 4, 1980

[54] METHOD FOR EXTENDING TRANSISTOR LOGARITHMIC CONFORMANCE

[75] Inventors: David E. Clouser, Claymont, Del.; Steven J. Engel, West Chester, Pa.

[73] Assignee: Hewlett-Packard Company, Palo Alto, Calif.

[21] Appl. No.: 974,582

[22] Filed: Dec. 29, 1978

[51] Int. Cl.[3] ..... G06G 7/24

[52] U.S. Cl. ..... 307/229; 328/145

[58] Field of Search ..... 307/229, 230; 328/145

[56] References Cited

U.S. PATENT DOCUMENTS

| | | | |
|---|---|---|---|
| 3,624,409 | 11/1971 | Folsom et al. | 307/229 |
| 3,681,618 | 8/1972 | Blackmer | 328/145 X |
| 4,100,433 | 7/1978 | Duffy et al. | 307/229 |

*Primary Examiner*—John S. Heyman

*Attorney, Agent, or Firm*—Donald N. Timbie

[57] ABSTRACT

The linear component appearing in the output of two logarithmic amplifiers connected for temperature compensation and having matched feedback semiconductor devices is cancelled in a resistor connected in series with a logarithmic device between the output and a point of reference potential so that a purely logarithmic voltage appears at their junction.

7 Claims, 1 Drawing Figure

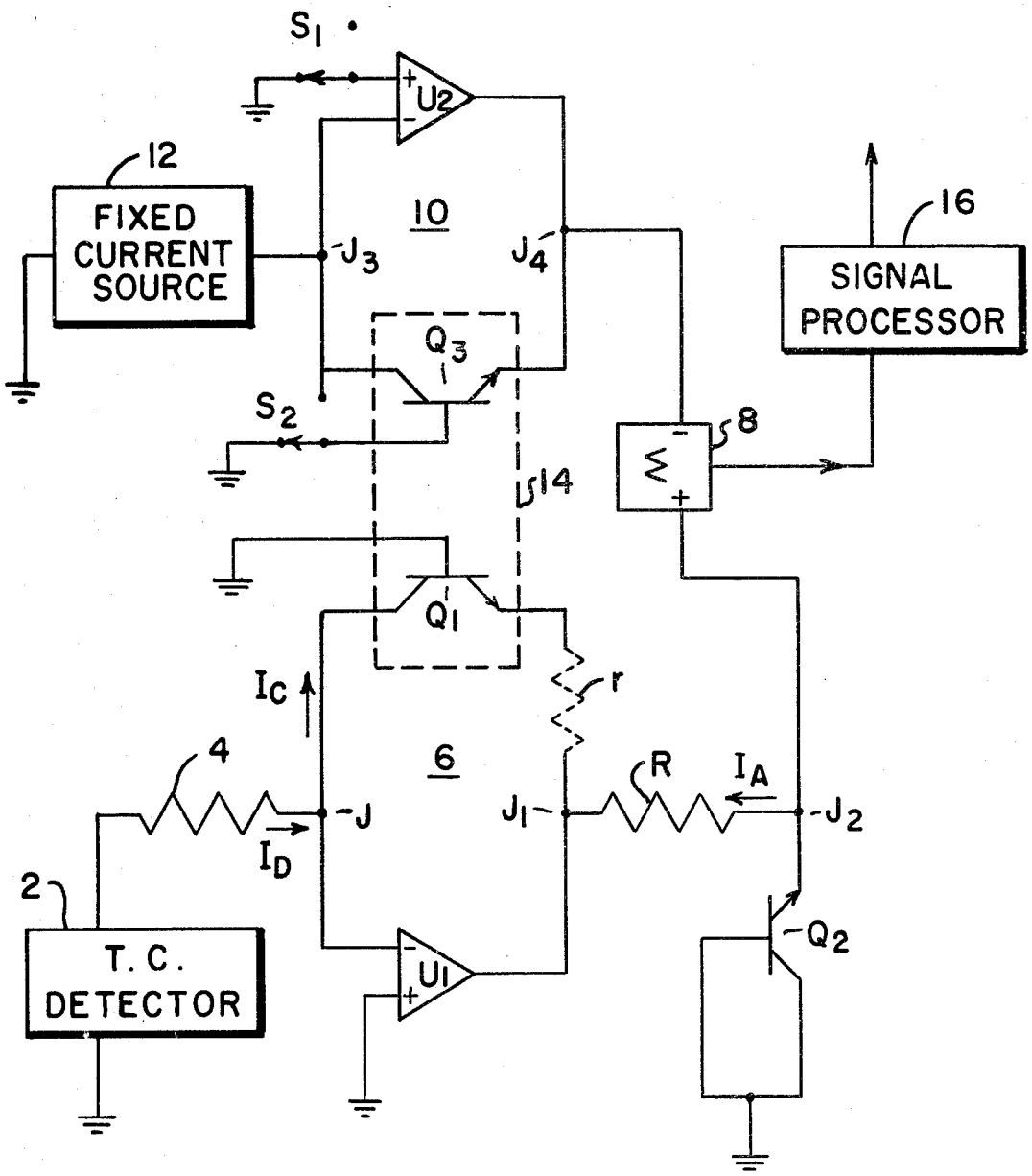
S1
U2
12
FIXED CURRENT SOURCE
10
J3
J4
16
SIGNAL PROCESSOR
Q3
S2
8
14
Q1
r
IC
4
6
R
IA
J
J1
J2
ID
2
T. C. DETECTOR
U1
Q2

METHOD FOR EXTENDING TRANSISTOR LOGARITHMIC CONFORMANCE

BACKGROUND OF THE INVENTION

The detector of a chromatograph provides an analog signal corresponding to the concentrations of sample material flowing through it. Before the information is applied to an integrator, certain processing functions are generally carried out by a digital system. In most cases, the dynamic range of the signal is so great that the digital system would have to have an excessively large number of bits if a reasonable degree of resolution is to be attained, but only a reasonable number of bits are required if the signal is first translated into logarithmic form. This may be accomplished by applying the signal to an operational amplifier circuit in which the feedback is provided by a transistor. If the detector is a voltage source, such as a thermal conductivity detector, it is connected via a coupling resistor to the inverting input of the amplifier. The non-inverting input is connected to a point of reference potential, and the desired logarithmic signal appears at the output. It is essential that there be very little noise or other distortion at the output of the amplifier because any error will be multiplied many times when the antilog of the processed signal is taken.

To compensate for variations in the temperature of the junction of the feedback transistor, a second operational amplifier and feedback transistor are provided. If the feedback transistors are a matched pair, the changes in the output of the operational amplifiers due to temperature variations can be substantially cancelled by subtracting one output from the other.

As is well known, the current flowing through the feedback transistor associated with the first operational amplifier equals the input current applied to it. As the latter current approaches the maximum current for which the feedback transistor is designed, an error term in logarithmic operation due to the internal resistance of the device becomes significant. The error term appears as a linear component in the output of the first operational amplifier. When the value of the resistor coupling a TC detector to the inverting input of the operational amplifier is adjusted for the best compromise between current and voltage noise, it is found that the current can exceed the maximum operating current of the feedback transistor so as to introduce a linear component into the logarithmic output. It might seem at first that this could be eliminated by using feedback transistors having a sufficiently high maximum current rating, but the feedback transistors must be a matched pair, and the available matched transistors do not have high enough current ratings.

BRIEF DESCRIPTION OF THE INVENTION

In a circuit incorporating this invention, a series circuit comprised of a resistor and a logarithmic device is connected between a point of fixed potential and the output of the operational amplifier to which the input signal is applied. The logarithmic device may be a compensating transistor of large geometry so that its internal series resistance is negligible compared to the external series resistance. The voltage produced across the external series resistor is of such polarity as to oppose the linear component of voltage in the output of the operational amplifier. If the compensating transistor is ideal, i.e., if it has no internal resistance in series with its emitter, the resistance of the external series resistor will be the same as the internal resistance of the feedback transistor.

DESCRIPTION OF THE DRAWING

The drawing is a schematic representation of an embodiment of the invention.

PREFERRED EMBODIMENT

In the drawing, a source 2, which may be a thermal conductivity detector, is coupled by a resistor 4 to the input at the junction J of a logarithmic amplifier 6. The amplifier 6 is shown as being comprised of an operational amplifier $U_1$ having its non-inverting input connected to a point of reference potential, its inverting input connected to the junction J, and its output connected to a junction $J_1$. Also included is a feedback transistor $Q_1$ with its emitter connected to $J_1$, its base connected to a point of reference potential, and its collector connected to the junction J. A resistance r shown in dotted line represents the internal resistance of the transistor $Q_1$ that is in series with the emitter-collector path.

A resistor R and the emitter-to-collector path of a compensating transistor $Q_2$ are connected in series between the output at $J_1$ of the logarithmic amplifier 6 and a point of reference potential. The emitter of $Q_1$ is connected to the resistor R, and its base and collector are connected to the resistor R, and its base and collector are connected to a point of reference potential so that $Q_2$ operates as a diode. The junction $J_2$ between the resistor R and the emitter of $Q_2$ is connected to one input of a subtracting means 8.

Temperature compensation is provided by another logarithmic amplifier 10 that is comprised of an operational amplifier $U_2$ and a feedback transistor $Q_3$. The inverting input of $U_2$ and the collector of $Q_3$ are connected to the output of a fixed current source 12 at a junction $J_3$, and the output of $U_2$ and the emitter of $Q_3$ are connected to an output junction $J_4$. The junction $J_4$ is connected to the inverting input of the subtracting means 8. In the particular circuit shown, the non-inverting input of $U_2$ and the base of $Q_3$ are connected to a point of fixed potential, but if it is desired to set the threshold voltage at the output of the subtracting means 8 at some offset value, such voltage could be applied via a switch $s_1$ to the non-inverting input of $U_2$. In this case, the base of $Q_3$ would be connected to its collector via a switch $s_2$.

In order to achieve temperature compensation, transistors $Q_1$ and $Q_3$ are a matched pair contained in a common structure indicated by the dotted rectangle 14. The output of the subtracting means 8 is connected to means 16 for processing the signals as desired.

OPERATION

Compensation for variation in the temperature of the junction of the feedback transistor $Q_1$ is provided by adjusting the current from the constant current source 12 to a value equal to the current flowing from the input signal source 2 to the junction J when the data signal has zero value. Because $Q_1$ and $Q_3$ are a matched pair, the voltages and the temperature coefficient of the voltages at $J_1$ and $J_4$ are equal so that subtracting either one from the other in the subtracting means 8 causes its output to be effectively insensitive to the transistor junction temperature, as desired.

The signal current $I_D$ must equal the collector current $I_c$ of $Q_1$. When the value of the resistor 4 is set so that the minimum value of $I_D$ provides an adequate signal-to-noise ratio in the output signal at $J_1$, larger values of the signal current $I_D$ and therefore $I_c$ exceed the maximum rated operating current of $Q_1$ so that the internal resistance r will have sufficient magnitude to introduce a large undesired linear component in the output voltage at $J_1$.

Cancellation of this linear component is achieved as follows. The operational amplifier $U_1$ will apply an output voltage to the emitter of $Q_1$ of such nature that the collector current $I_c$ equals the signal current $I_D$. Because the voltage $V_{BE}$ between the emitter and base of $Q_2$ must be proportional to the logarithm of the collector current $I_c$, the voltage at the junction $J_1$ must also be logarithmic. It is to be noted that the presence of the internal resistance r requires that the voltage at the junction $J_1$ have an added linear component equal to $I_c r$. The voltage $V_{J1}$ at the junction $J_1$ can be expressed by the following equation in which K is Boltzmann's constant; T is the absolute temperature; q is the charge of an electron; and $I_s$ is the maximum current flowing through $Q_1$ when it is back-biased.

$$V_{J1} = -\frac{KT}{q} \ln \frac{I_c}{I_s} - I_c r \quad (1)$$

The voltage $V_{J1}$ will cause a current $I_A$ to flow through the resistor R and $Q_2$. The voltage $V_{J2}$ that is produced by this current at the junction $J_2$ is represented by the following equation, wherein the constants are the same as in equation (1).

$$V_{J2} = -\frac{KT}{q} \ln \frac{I_A}{I_s} \quad (2)$$

The transistor $Q_2$ is of such geometric proportion that its internal resistance can be neglected for the currents involved. If $Q_2$ is ideal, this resistance is in fact zero. With the value of R set so that $I_A R = -I_c r$. the undesired linear component $I_c r$ at the output of the log amplifier 6 is cancelled in the resistor R. In most situations, $I_A/I_s$ of $Q_2$ will equal $I_c/I_s$ of $Q_1$, so that if the internal resistance of $Q_2$ is zero, R will be equal to r.

It will be understood that the polarity of the output voltage from the subtracting means 8 could be reversed by interchanging the connections of its positive and negative inputs. Diodes or other logarithmic devices could be substituted for the transistors as long as those substituted for $Q_1$ and $Q_3$ are a temperature matched pair.

What is claimed is:

1. Apparatus comprising, a thermal conductivity detector, a first operational amplifier having an inverting input, a non-inverting input, and an output, a first resistor connected between the output of said thermal conductivity detector and the said inverting input of said first operational amplifier, means connecting the non-inverting input of said first operational amplifier to a point of reference potential, a first transistor having its emitter connected to the output of said first operational amplifier, its base connected to a point of reference potential, and its collector connected to the inverting input of said first operational amplifier, a second transistor connected as a diode and a second resistor connected between a point of reference potential and the output of said first operational amplifier, a subtracting means having first and second inputs and an output, a connection between the first input of said subtracting means and the junction of said second resistor and said second transistor, a second operational amplifier having inverting and non-inverting inputs and an output, a connection between the output of said second operational amplifier and the second input of said subtracting means, a source of fixed current equal to the current supplied by said thermal conductivity detector to the inverting input of said first operational amplifier under a no-signal condition, a connection between said source and the inverting input of said second operational amplifier, a third transistor having its emitter connected to the output of said second operational amplifier and its collector connected to inverting input of said second operational amplifier, said first and third transistors being a matched pair, means for setting the non-inverting input of said second operational amplifier at a given potential with respect to the reference potential, and means for setting the base of said third transistor at a potential having a predetermined relationship to the reference potential.

2. Apparatus as set forth in claim 1 wherein said non-inverting input of said second operational amplifier and the base of said third transistor are connected to a point of reference potential.

3. Apparatus as set forth in claim 1 wherein means are provided for applying an offset voltage to the non-inverting input of said second operational amplifier and the base of said third transistor is connected to its collector.

4. Apparatus for deriving the logarithm of an input signal, comprising a first logarithmic amplifier having an input to which a data signal may be applied and an output, said amplifier being comprised of a first operational amplifier and a first logarithmic feedback semiconductor device, both being referenced to a point of reference potential, a series circuit comprised of a resistor and a logarithmic device connected between the output of said first logarithmic amplifier and the point of reference potential, a subtracting means having first and second inputs and an output, a connection between said first input of said subtracting means and the junction of said resistor and said logarithmic device, a second logarithmic amplifier having an input to to which a fixed signal may be applied and an output, said amplifier being comprised of a second operational amplifier and a second feedback semiconductor device, a connection between the output of said second logarithmic amplifier and the second input of said subtracting means, said first and second feedback semiconductor devices being a matched pair.

5. Apparatus as set forth in claim 4 wherein said first and second logarithmic feedback semiconductor devices are transistors.

6. Apparatus as set forth in claim 5 wherein said logarithmic device is a transistor.

7. Apparatus as set forth in claim 4 wherein said logarithmic device is a transistor.

* * * * *